United States Patent [19]

Suzuki

[11] 4,298,780

[45] Nov. 3, 1981

[54] MICROWAVE HEATING APPARATUS WITH RESISTIVE HEATERS

[75] Inventor: Yukio Suzuki, Fuji, Japan

[73] Assignee: Tokyo Shibaura Denki Kabushiki Kaisha, Kawasaki, Japan

[21] Appl. No.: 129,644

[22] Filed: Mar. 12, 1980

[30] Foreign Application Priority Data

Mar. 19, 1979 [JP] Japan ..... 54-35246[U]

[51] Int. Cl.[3] ..... H05B 6/68; H05B 6/76

[52] U.S. Cl. ..... 219/10.55 B; 219/10.55 D; 219/10.55 C

[58] Field of Search ..... 219/10.55 B, 10.55 D, 219/10.55 C, 10.55 E, 10.55 R; 200/61.59; 126/197

[56] References Cited

U.S. PATENT DOCUMENTS

| | | | |
|---|---|---|---|
| 3,196,243 | 7/1965 | Schall | 219/10.55 D |
| 3,700,846 | 10/1972 | Ishikawa et al. | 219/10.55 C |
| 4,191,877 | 3/1980 | Tanaka et al. | 219/10.55 D X |

*Primary Examiner*—Gene Z. Rubinson
*Assistant Examiner*—Philip H. Leung
*Attorney, Agent, or Firm*—Cushman, Darby & Cushman

[57] ABSTRACT

A microwave heating apparatus comprises a heating chamber, high frequency radio wave generator and heating resistors selectively connected through first and second switches to a power supply, and a control circuit connected through the first switch to the power supply. The heating apparatus also comprises heating resistor coupling units each including a displaceable member and a third switch. The displaceable member is displaced when the heater end is inserted into a predetermined position of the coupling unit. The third switch is closed when this displaceable member is displaced. This third switch is connected in series between the first switch and the control circuit. The high frequency radio wave generator or the heater is not connected to the power supply unless the heater end is completely connected to the heater coupling unit. Accordingly, it can prevent external leakage of the radio wave, dielectric breakdown accident or the like.

5 Claims, 6 Drawing Figures

MICROWAVE HEATING APPARATUS WITH RESISTIVE HEATERS

This invention relates to a microwave heating apparatus which incorporates a heater provided in a foodheating chamber thereof for externally heating food disposed in the heating chamber.

There is publicly known a microwave heating apparatus which provides heaters in a food heating chamber for externally heating the food. According to this conventional heating apparatus, a high frequency radio wave from a high frequency radio wave generator containing, for example, a magnetron is supplied into the heating chamber for cooking the food by heating internally for short time in a microwave heating mode, and the food is externally heated for roasting the surface of the food by controlling heating temperature delicately in a resistor heating mode. In the microwave heating apparatus of this type, heaters provided in the heating chamber are frequently detached and attached in general as required when cleaning the interior of the heating chamber or due to the size of the food to be cooked in the microwave heating mode. It must prevent completely a dielectric breakdown accident, an improper contact, the external leakage of radio wave or the like which may occur when the heaters are once detached and are again connected to a power supply. The conventional heating apparatus is not, however, improved to satisfactorily eliminate the aforementioned problems.

With reference to FIGS. 1 and 2, the problems of the conventional heating apparatus will now be described in detail in order to readily understand the present invention.

In FIG. 1, the housing 11 of the microwave heating apparatus of this type includes an internal housing 11*a* forming a heater chamber 14, and an external housing 11*b*. The housing 11 also incorporates a space 11*c* formed between the housings 11*a* and 11*b*. The housing 11 also has a door 15 provided at the front thereof to open or close the front face of the heating chamber 14. The housing 11 internally installs a rack plate 16, an upper heater 17 above the rack plate 16 and a lower heater 18 below the rack plate 16 horizontally in the heating chamber 14. There are mounted a pair of heater coupling units 19*a* for holding the voltage supply terminals of the heater 17 at the rear wall 19 of the internal housing 11*a*, and a pair of heater coupling units 19*b* for holding the voltage supply terminals of the heater 18 at the rear wall 19. The voltage supply terminals of the respective heaters 17 and 18 are supplied with the voltage from a power supply. A tray 21 carrying food 20 thereon is placed on the rack plate 16 in the housing 11. The housing 11 contains a high frequency radio wave generator 22 including a magnetron in the space 11*c*, which generator 22 supplies high frequency radio wave through a waveguide 23 into the heating chamber 14.

The prior heater coupling unit corresponding to the heater coupling unit 19*a*, for example, in such a microwave heating apparatus is constructed as shown in FIG. 2. In FIG. 2, at the rear wall 19 of the internal housing 11*a* is perforated a hole or an opening 24, to the periphery of which is fixed one end of a known radio wave attenuating tube 25 extending horizontally into the space 11*c* of the housing 11. A plurality of contact members 26*a*, 26*b*, . . . of elastic metal are fixedly secured to the other end of the radio wave attenuating tube 25, and are grounded through the attenuating tube 25. Thus, the high frequency radio wave transmitted from the heating chamber 14 to the heater 17 and attenuated via the attenuating tube 25 is introduced to a grounding circuit. The voltage supply terminal of the heater 17 is inserted through the central portion of the attenuating tube 25, interposed between the contact members 26*a* and 26*b*, and connected at the leading end thereof to a connector 27, to which a voltage is applied. The end portion of the heater 17 is coated in a predetermined length portion thereof excluding the leading end thereof by a sheath 28 formed of insulator. The end of the sheath 28 at the side of the connector 27 is protected by an insulating tube 29. The sheath 28 makes contact with the contact members 26*a* and 26*b*. The end making contact with the leading end of the heater 17 of the connector 27 is protected by an insulator 30. The heater coupling unit 19*a* is also entirely covered by a metallic hollow cylinder 31 having known radio wave attenuating function.

However, the heater coupling unit shown in FIG. 2 has the following disadvantages. When the heater 17 is repeatedly detached from and again attached to the heater coupling unit, the contacting pressure between the contact members 26*a*, 26*b*, . . . and the sheath 28 is reduced to feasibly occur gap between the contact members 26*a*, 26*b*, . . . and the sheath 28 and to accordingly take place a spark in the gap. When this spark remarkably occurs, the sheath 28 is perforated to thereby introduce a dielectric breakdown accident threat so as to thus cause a fire. In addition, the high frequency radio wave transmitted via the heater 17 readily passes through the gap into the connector 27 to thereby cause so-called an external leakage of the radio wave. Accordingly, it thus becomes difficult to maintain the safety of the entire microwave heating apparatus.

Accordingly, a primary object of this invention is to provide a microwave heating apparatus which incorporates heater coupling units capable of reducing occurrence of the aforementioned spark, dielectric breakdown accident, external leakage of radio wave, or a fire.

This invention contemplates to provide a microwave heating apparatus which comprises a heating chamber for heating food; a high frequency radio wave generator selectively connected to a power supply through first and second switches for supplying high frequency radio wave into the heating chamber and at least one heater provided in the heating chamber and selectively connected to the power supply through the first and second switches for heating the food by means of resistance; heater coupling means mounted at the wall of the heating chamber for detachably holding the voltage supply terminal of the heater; and a control circuit connected through the first switch to the power supply for controlling the ON-OFF operation of the second switch; the heater coupling means includes a displaceable member displaced when the voltage supply terminal of the heater is inserted into a predetermined position of the heater coupling means and a third switch closed when the displaceable member is displaced; the third switch is connected in series with the control circuit for setting the control circuit to be operated only when the third switch is closed.

The above and other related objects and features of the invention will be apparent from the following description of the disclosure and the accompanying drawings, in which.

Figure 1:
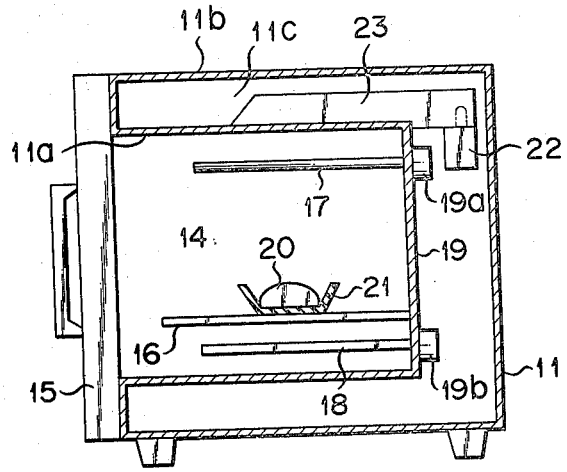
FIG. 1 is a partial sectional view of a microwave heating apparatus for explaining the high microwave apparatus according to this invention.
Figure 2:
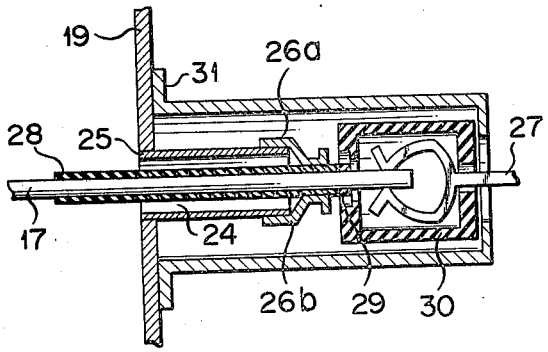
FIG. 2 PRIOR ART
FIG. 2 is a partially enlarged sectional view of the conventional example of the heater coupling unit shown in FIG. 1.
Figure 3:
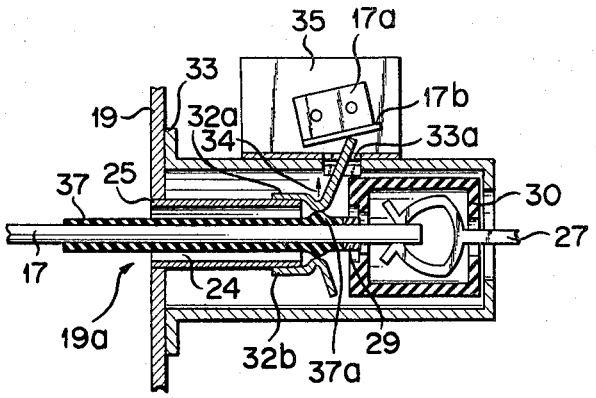
FIG. 3 is a partially enlarged sectional view of one preferred embodiment of the heater coupling unit according to this invention but showing the case that the heater is inserted to a predetermined position.

Since the configuration of the microwave heating apparatus according to this invention is the same as shown in FIG. 1, it will not be described any further. As the like reference numerals in the drawings designate the parts of the same construction and operation, the construction and operation will not be described any further except for particular necessity. In FIG. 3, to the outer periphery of the hole or opening 24 perforated at the internal housing 11*a* of the housing 11 is fixed a radio wave attenuating hollow cylinder 25 at one end thereof and to the other end of which cylinder 25 are fixed one respective ends of a plurality of contact members 32*a*, 32*b*, . . . each formed of elastic metal and having bent portion and extension. A metallic hollow cylinder 33 connected at one end thereof to the rear wall 19 and having the same operational effect as the metallic hollow cylinder 31 shown in FIG. 2 is perforated with a hole or opening 33*a*. The contact member 32*a* provided at the position facing the opening 33*a* of the cylinder 33 is different in shape from the contact member 32*b*. The contact member 32*a* is displaced at the extension extended through the opening 33*a* in the direction as designated by an arrow 34 when the bent portion of the contact member 32*a* is urged in the direction similarly designated by the arrow 34. In the vicinity of the opening 33*a* of the cylinder 33 is fixed a switch mounting plate 35, to which plate 35 is fixed a microswitch 17*a* having an actuator 17*b*. This microswitch 17*a* is closed by the actuator 17*b* when the extension of the contact member 32*a* is displaced in the direction of the arrow 34. At the voltage supply terminal of the heater 17 is provided with an insulating sheath 37 corresponding to the insulating sheath 28 shown in FIG. 2, an insulating tube 29, and a projection 37*a* at a predetermined position at which the projection 37*a* contacts with the members 32*a* and 32*b* elastically. When the voltage suppply terminal of the heater 17 is inserted at the position of the heater coupling unit 19*a*, the extension of the contact member 32*a* is displaced in the direction of the arrow 34 to thereby close the switch 17*a* via the actuator 17*b*. When the microswitch 17*a* is closed, the leading end of the heater 17 is completely connected to the connector 27. Since the contact member 32*a* is pushed up by the projection 37*a* of the sheath 37, the sheath 37 makes complete contact with the contact member 32*a*. Thus, the radio wave transmitted via the heater 17 is introduced through the sheath 37, the contact member 32*a*, the radio wave attenuating cylinder 25 and the rear wall 19 into the grounding circuit.

Figure 4:
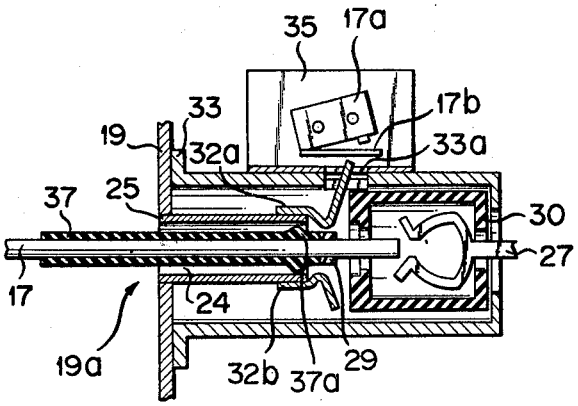
FIG. 4 is a view similar to FIG. 3 but showing the case that the heater is not yet inserted to the predetermined position.

As shown in FIG. 4, when the voltage supply terminal of the heater 17 is not yet inserted into the predetermined position of the heater coupling unit 19*a*, since the projection 37*a* of the sheath 37 does not make contact with the bent portion of the contact member 32*a*, the contact member 32*a* is not displaced as predetermined. Accordingly, the actuator 17*b* is not driven and the microswitch 17*a* is not closed.

Figure 5:
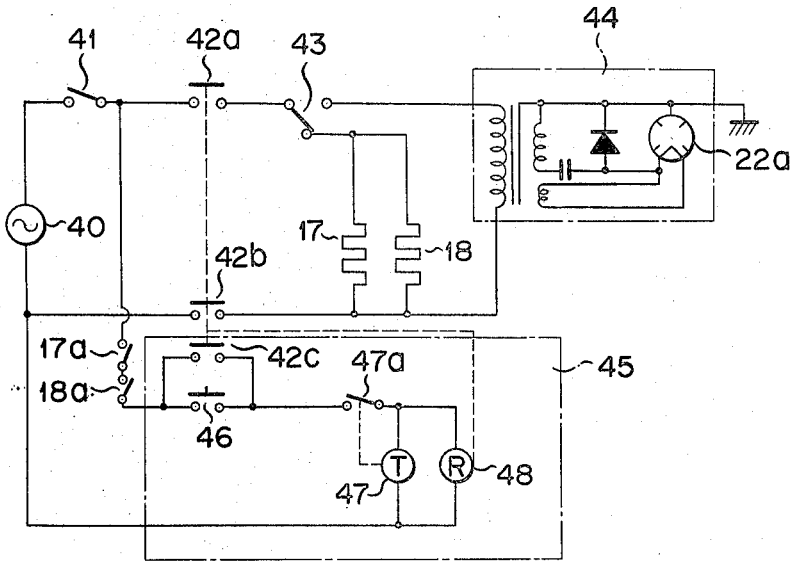
FIG. 5 is a circuit diagram of one example of the heating apparatus according to this invention.

Referring now to FIG. 5 showing one example of the circuit diagram of te microwave heating apparatus according to this invention, the connection and operation of the microswitch 17*a* will now be described in detail. A commercial power supply 40 is connected through first switch 41, second switches 42*a*, 42*b*, changeover switch 43 to a high frequency radio wave generator 44 including a magnetron 22*a* or to upper and lower heaters 17 and 18. The power supply 40 is also connected through the switch 41, the switch 17*a* provided at the heater coupling unit 19*a* of the upper heater 17, and the switch 18*a* provided at the heater coupling unit 19*b* of the lower heater 18 to a control circuit 45 for controlling the ON-OFF operation of the second switches 42*a* and 42*b*. The changeover switch 43 operates to selectively supply power to the high frequency radio wave generator 44 and the heaters 17 and 18. The control circuit 45 contains a start switch 46 connected in series with the switches 17*a* and 18*a*, a timer switch 47*a*, a relay 48, a switch 42*c* connected in parallel with the start switch 46 for self-holding the relay 48, and a timer 47 connected in parallel with the relay 48. When the timer 47 is set at a predetermined time, the timer switch 47*a* is automatically closed, and is opened upon lapse of the predetermined time. The switches 42*a*, 42*b* and 42*c* incorporate normally open contacts, respectively and are closed when the relay 48 is energized.

In FIG. 5, when the high frequency radio wave generator 44 is selectively connected to the power supply 40 and at least one of the upper and lower heaters 17 and 18 such as, for example, the upper heater 17 is incompletely inserted into the heater coupling unit 19*a* as shown in FIG. 4, the microswitch 17*a* is opened. Accordingly, even if the start switch 46 is depressed, the high frequency radio wave generator 44 is not operated. Therefore, it can completely prevent external leakage of the radio wave. In case where the contacting pressure of the contact member 32*a* is weakened to thereby occur a gap between the projection 37*a* and the curved portion of the contact member 32*a*, since the microswitch 17*a* is not closed, it can similarly prevent external leakage of the radio wave. It should be understood from the foregoing description that since the microwave heating apparatus according to this invention is thus constructed and operated, it can readily prevent the dielectric breakdown accident, occurrence of a fire, external leakage of the radio wave or the like.

Figure 6:
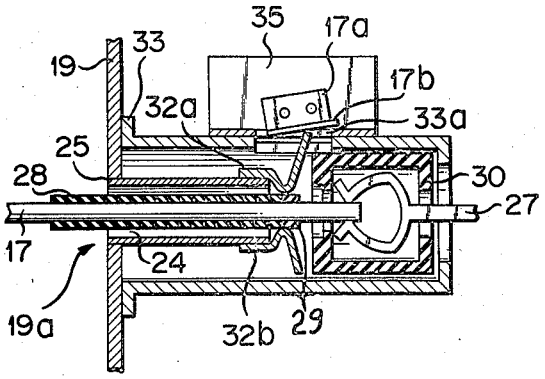
FIG. 6 is a partially enlarged sectional view of another preferred embodiment of the heater coupling unit according to this invention.

It is noted that although the embodiment in which the projection 37*a* is provided at the sheath 37 of the heater 17 has been described with reference to FIG. 3, the heater coupling unit may also be constructed according to the configuration shown in FIG. 6. In FIG. 6, the contact member 32*a* is displaced only when it is depressed by the sheath 28 of the heater 17 to thereby close the microswitch 17*a*, but the microswitch 17*a* is not closed at the position where the heater 17 itself faces at the surface thereof with the curved portion of the contact member 32*a*.

What is claimed is:

1. A microwave heating apparatus comprising:

a heating chamber for receiving food to be heated by said heating apparatus, said heating chamber having a wall with a bore therethrough;

a microwave generator for generating microwave energy to be conducted within said heating chamber for microwave heating food within said chamber;

a detachable resistive heating element for generating heat within said chamber for heating food within said chamber, said element having a voltage terminal and an insulating sheath wrapped about a portion thereof, the sheath having a projection thereon;

a control circuit for selectively coupling power from a power source to said microwave generator and/or said resistive heating element; and a heater coupling means positioned substantially at the bore in said wall but on the opposite side thereof from said heating chamber for (a) holding said detachable resistive heating element within said chamber and (b) coupling electrical power from said control circuit to said terminal of said resistive heating element, said heater coupling means including a displaceable member adapted to be displaced when an elbow portion thereof fully contacts with said projection of said insulating sheath whenever said detachable resistive heating element is inserted through said bore to a predetermined position within said heater coupling means; and a switch element, actuable by said displaceable member, for inhibiting said control circuit from applying power to said microwave generator and resistive heating element when said heating element is not inserted to said predetermined position.

2. A microwave heating apparatus according to claim 1 including first and second detachable resistive heating elements provided so that said first heating element is provided at an upper portion of said heating chamber and said second heating element is provided at a lower portion of said heating chamber.

3. A high frequency heating apparatus according to claim 1, wherein said heater coupling means further comprises a microwave attenuating cylinder fixedly secured to said heating chamber wall about the periphery of said bore and extending from the opposite side thereof from said heating chamber.

4. A high frequency heating apparatus according to claim 3, wherein said projection is formed by a portion of the insulating sheath that is thicker than the insulating sheath at the other portions thereof.

5. A high frequency heating apparatus according to claim 1 wherein said control circuit comprises a series circuit of said switch element and further comprises a start switch for self-holding, a relay for controlling the ON-OFF operation of a second switch, and a timer connected in parallel with said relay; such that when said switch element and start switch are closed and said timer is set at a predetermined time, said relay closes said second switch, and opens said second switch upon lapse of said predetermined time.

* * * * *